United States Patent [19]

Harmsen

[11] 4,356,968

[45] Nov. 2, 1982

[54] RAILROAD TIE COVER

[75] Inventor: John L. Harmsen, Vienna, Va.

[73] Assignee: Stedef S.A., Saint-Cloud, France

[21] Appl. No.: 195,921

[22] Filed: Oct. 10, 1980

[51] Int. Cl.[3] ..... E01B 26/00

[52] U.S. Cl. ..... 238/1; 238/83

[58] Field of Search ..... 238/2, 29, 62, 82–84, 238/98, 104, 107, 116, 118, 283, 382, 1

[56] References Cited

U.S. PATENT DOCUMENTS

| | | | |
|---|---|---|---|
| 1,218,141 | 3/1917 | Wells | 238/107 X |
| 3,289,941 | 12/1966 | Sonneville | 238/116 |
| 3,295,760 | 1/1967 | Moses | 238/283 |
| 3,790,078 | 2/1974 | Egerbork et al. | 238/283 X |
| 3,920,183 | 11/1975 | Houghton | 238/283 |
| 3,945,566 | 3/1976 | Bush | 238/283 X |
| 4,117,977 | 10/1978 | Whitlock | 238/8 |

FOREIGN PATENT DOCUMENTS

| | | | |
|---|---|---|---|
| 298540 | 5/1972 | Austria . | |
| 304598 | 10/1973 | Austria . | |
| 8743 | 3/1980 | European Pat. Off. | 238/2 |
| 52-11504 | 1/1977 | Japan | 238/2 |
| 52-18610 | 2/1977 | Japan | 238/2 |

*Primary Examiner*—Randolph A. Reese

*Attorney, Agent, or Firm*—Breneman, Kane & Georges

[57] ABSTRACT

A railroad timber tie cover of a substantially rectangular configuration composed of an elastomer material is provided for increasing the resiliency of rail fastening track systems in railroad track beds with and without ballast to prolong the service life of timber and concrete railroad ties. The railroad tie cover has a center and two side portions which utilize a plurality of grooves that are designed to prolong the operational life of wooden timber ties by increasing the resiliency of the rail fastening system and in the case of the wooden timber ties prolong the life of the tie by channeling and transporting water and moisture away from the railroad timber tie. The number, depth and disposition of the grooves foster the circulation of air around the timber tie during the loading and unloading of the track as occurs during train passage. The railroad tie cover is designed to be manufactured and shipped in a flat configuration which is installed as a three dimensional cover at the work site. The rail tie cover can be cut and trimmed at the work site to accomodate varying lengths of wooden rail ties as may be required for special track work.

11 Claims, 8 Drawing Figures

RAILROAD TIE COVER

BACKGROUND OF THE INVENTION

1. Field of the Invention

The present invention pertains to a resilient railroad tie cover of a generally rectangular configuration which when attached to railroad ties increases the resiliency of the rail track system while increasing the service life of wooden railroad timber ties. More particularly, the invention provides a railroad timber tie cover susceptible of manufacture and shipment in a flat configuration having a plurality of grooves designed to dampen and distribute vibrations of low frequency and load forces in timber ties while aerating and removing moisture and water from timber ties. The novel configuration and design of the tie cover allows the tie cover to be shipped in a flat configuration and thereafter be cut and installed to form a three dimensional timber tie cover at the work site to accomodate varying lengths of wooden rail ties that is particularly useful in special track sites such as is employed at rail switches. The utilization of a plurality of channels and grooves in the railroad timber tie cover or sleeve not only assists in the dampening and distributing of load during the train passage but also provides improved rail operation by the reduction of noise and the increase of resiliency in rail tracks with or without ballast.

2. Description of the Prior Art

The prior art employs a variety of fastening devices in combination with resilient pads for increasing the resiliency of railroad track with and without ballast. Conventional railroad track systems utilized in the United States predominantly employ a ballasted bed of broken stones which support wooden railroad ties and impart some resilience to the railroad system. The utilization of ballast is the predominant method of imparting resiliency to railroads in the United States which has also resulted in harder and noisier railroad tracks. In some applications, however, such as in tunnel operations or in environments where the utilization of deep beds of ballast are not practical, resilient pads have been interposed between the railroad track and the railroad tie to increase the resiliency of the railroad system. One such application of a rubber pad to increase the resiliency of a rail positioned on a portion of a wooden tie is illustrated in U.S. Pat. No. 2,779,543.

In many track applications in European countries, wooden ties are not utilized and railroad track systems are in widespread use that do not use ballast. To obtain resiliency, elastomer pads or block tie boots which fit over and around the concrete railroad ties are employed. Illustrative of railroad track systems utilizing railroad track without ballast is U.S. Pat. No. 3,289,941. In such systems, resiliency is imparted by employing a rubber boot or sheath interdisposed between a concrete tie block and the continuous floor formed of cement, concrete or black concrete. Unlike the present invention, this prior art system employs a fluid tight sheath which is not designed to provide drainage and aeration of a wooden tie. Due to the shape of the prior art, such prior art cannot be used with conventional timber ties.

The known prior art systems in use in the United States for wooden railroad timber ties employ rubber pads and similar resilient supports to increase the resiliency of the railroad systems. Such systems are not designed for the purpose of increasing the operational life of the wooden railroad tie by assisting in the drainage of water from the wooden rail tie and drawing air into and around the railroad tie by the loading or unloading of the railroad tie systems such as occurs during the passage of trains. The application of a railroad tie cover of the present invention, constructed of an elastomer material, is designed to not only increase the resiliency of traditional railroad beds with ballast as utilized in American railroad systems, but also to increase the life of the railroad timber tie by allowing moisture to be drained from railroad timber ties while providing necessary aeration to increase the service life of wooden railroad ties.

In the application of the rubber pads to U.S. prior art systems, the rubber pad has traditionally been interposed between the wooden tie and the steel tie plate upon which the steel rail is placed in order to impart resiliency to the overall system. The present invention unlike the prior art does not attempt to increase the resiliency of the overall system by the utilization of a pad between the railroad tie and the rail tie plate. The present invention is instead directed to the utilization of a resilient covering for a railroad tie, that is interposed between the railroad tie and a railroad bed which may or may not utilize the ballast. The present invention employs a railroad tie cover for railroad systems with and without ballast wherein the overall resiliency of the system is achieved by the modification of the relationship between the thickness of the supporting surface of the railroad tie cover in conjunction with the depth and number of grooves that further provide for the aeration and channeling of water away from the wooden railroad tie.

The invention further provides a railroad timber tie cover that is particularly advantageous for application to wooden railroad ties while allowing it to be manufactured, shipped and stored at a minimum cost as a result of its novel configuration and design. The railroad tie cover is susceptible to extrusion or molding processes that form a flat and substantially rectangular pad which may thereafter be installed on traditional wooden railroad ties by bending and fastening the ends around the sides of the railroad timber tie. In addition, the railroad timber tie covers can be installed on standard timber tie lengths or cut to various sizes at the work site to accomodate timber tie lengths of varying sizes which are predominantly employed at rail switching and other special track work sites.

The utilization of the novel railroad timber tie covers of the present invention further allows the dissipation of shock and vibration that impair the integrity and useful life of the railroad tie fastening system while at the same time prolonging the useful life of the railroad tie. The utilization of grooves and channels in the tie cover center support for the tie of the present system in addition to removing moisture and prolonging the life of the railroad timber tie also reduces rail support hardness and improves the performance of U.S. rail systems by noise reduction and the necessity of maintenance on railroad tie systems utilizing wooden ties.

SUMMARY OF THE INVENTION

The disadvantages and limitations of prior art systems for increasing the resiliency of rail systems are obviated while providing additional advantages in preserving and prolonging the operational life of wooden rail tie systems. The present invention not only augments the resilience of the entire rail track system, but also provides a protective cover or sleeve that shields the railroad timber tie from the rail bed surfaces that may or may not employ ballast. Where ballast is utilized, the advantages of the invention are further augmented by distributing the load more evenly along the entire bearing surface of the timber tie while preventing undue wear between the points of contact between the wooden railroad timber tie and the railroad bed supporting the wooden rail ties. In ballast applications where the rail bed is made of aggregate the invention allows wooden ties to be positioned on the railroad bed while achieving the necessary resiliency by utilizing the construction and design of the protective rail cover. In addition to the advantages of providing an overall more resilient rail system and the incumbent advantages of reduction of noise and the dissipation of stresses and vibrational forces, the present invention further prolongs the life of railroad timber ties by removing moisture from the railroad timber tie and providing aeration to the bottom surface and sides of the timber tie particularly during the loading and unloading of the rails such as occurs with the passage of trains over the rail surface.

The present railroad tie protective cover or sleeve is formed from rubber or other elastomer material to form a substantially flat rectangular cover or sleeve. The elastomer sleeve can be formed either by a molding process or by the utilization of extrusion processes such as are well known in the art. The formation of the flat rubber sleeve simplifies the production and manufacture of the rubber sleeve and at the same time provides additional advantages in storage, transportation, and utilization of protective covers or sleeves for railroad timber ties. In the preferred embodiment of the present invention, it is contemplated that protective covers formed in accordance with the present invention may be trimmed, cut and installed on railroad timber ties at the work site in a number of configurations depending upon the nature of the track and the particular application utilized.

On one side of the protective railroad timber tie cover a series of grooves or channels are provided which thereafter form the inside supporting surface of the railroad timber tie cover that functions to channel water away from the bottom of the railroad timber tie. On the two side portions of the railroad timber tie similar channels or grooves are provided for dissipating moisture and providing aeration to the railroad timber tie during the passage of trains over the railroad timber tie.

In accordance with the preferred embodiment of the invention, the center portion and ends of the railroad timber tie cover or sleeve are not of a uniform cross-sectional thickness. In most applications, the center portion of the railroad timber tie cover is of a greater thickness than the two end portions which are designed to conform to the contour of the sides of the wooden timber tie. The thickness of the center portion which supports the timber tie in conjunction with the number and depth of the grooves utilized for the center portion of the railroad timber tie are designed to provide drainage and aeration for the railroad timber tie.

In the preferred embodiment of the invention the composition and thickness of the center portion is maintained at a constant, but the shape factor of the railroad tie cover is modified by changing the number and depth of the grooves. In the preferred embodiment of the invention an elastomer material having a shore A hardness in the range of 60 is utilized having a center portion having a cross-sectional thickness in the range of about $\frac{3}{8}$ to $\frac{5}{8}$ of an inch with grooves or water channels being approximately 1 to 3 per inch resulting in the grooves being spaced from about $\frac{1}{3}$ to 1 inch from each other with the depth of the grooves being about $\frac{1}{4}$ to $\frac{3}{8}$ of an inch. It will, of course, be recognized that modifications to the groove channels, their configuration and depth may be made to provide greater or lesser degrees of resilience and aeration for the bottom of the railroad timber tie.

The cross-sectional thickness of the center portion of the railroad timber tie cover may be modified in relation to the number of grooves and/or the depth of the grooves provided in the bottom portion of the railroad timber tie. The side or end portions of the railroad timber tie are generally of a reduced thickness generally in the neighborhood of about $\frac{1}{4}$ to $\frac{3}{8}$ of an inch in cross-sectional thickness and traditionally utilize from about 2 to 4 grooves per inch resulting in the grooves being spaced at about $\frac{1}{4}$ to $\frac{1}{2}$ of an inch apart. Generally, the number and depth of the grooves on the side portion is not as important as in the bottom portion unless the railroad timber tie is embedded in the railroad bed in a ballastless system. Substantially perpendicular to the grooves on the sides are a number of water channels that may be disposed along the length of the ends at a distance of about 15 centimeters which transport moisture or water from the sides of the timber tie cover to the bottom portion of the timber tie cover to thereafter be removed from the railroad timber tie cover.

In ballastless railroad track systems the cross-sectional center portion of the railroad timber tie cover is of increased cross-sectional thickness typically in the range of about $\frac{1}{2}$ to $\frac{3}{4}$ of an inch and the grooves are spaced from about $\frac{1}{2}$ to 1 inch apart in order to remove water and moisture from the timber tie while at the same time imparting increased resiliency to the overall railroad tie track system. Generally, the cross-sectional thickness in conjunction with the depths of grooves pertain to rubber sleeves that are constructed from an elastomer having a shore A hardness in the range of about 60.

The application of the railroad timber tie covers to railroad timber ties in either ballastless or systems utilizing ballast employs the flat center portion to support the bottom of the timber rail tie while the side portions are bent to conform to the sides of the railroad timber tie and fastened by the utilization of nails, adhesives or other such known fastening devices. In order to facilitate the contour shaping of the railroad timber tie cover to the railroad timber tie the rubber wall at the division between the center portion of the railroad timber tie and the end portion is of reduced thickness. Optionally the reduced thickness resulting from the molding process will when installed on a tie form a side water channel to assist in the removal of moisture from the railroad timber ties.

The present invention provides further advantages in the shipment and installation of the railroad timber tie covers since they are amenable for shipment in a flat condition and therafter contoured and installed at the work site. The installation of the railroad timber tie covers contemplate the cutting of the railroad timber tie to accomodate the wide range of special timber tie lengths which can be utilized in special track work. Generally, the sleeves are made in lengths of about 40 or 60 inches which are sufficient lengths to accomodate standard timber ties. However, in special track work such as at rail switches other lengths can be easily accomodated by cutting the railroad timber tie cover to the desired lengths at the work site. In some applications, a special flap or cover is made for the end of the timber tie which may also be utilized to provide the advantages of water and moisture drainage and circulation of air around the timber tie.

The present invention provides a number of advantages which result in improved resiliency and the protection of railroad timber ties. The invention further combines the benefits of increased resiliency with the removal of water and aeration by the utilization of grooves and channels which allow the circulation and breathing of air that results when trains pass over the rail by the weight of the train upon the bottom of the timber tie cover which causes deflection and rebounding of the bottom and sides of the timber tie covers.

The features of the invention reduce required track maintenance, noise and vibration and increase the operational life of timber ties thereby providing a safer and quieter train ride which results in reduced strain and vibrational forces upon the timber ties. In addition, as a consequence of the design and construction of the novel railroad timber tie cover the invention can be conveniently and inexpensively implemented by extrusion or molding processes which allows the sleeves to be shipped to the work site in a flat configuration and thereafter be installed to suit the particular track requirements at the job site.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
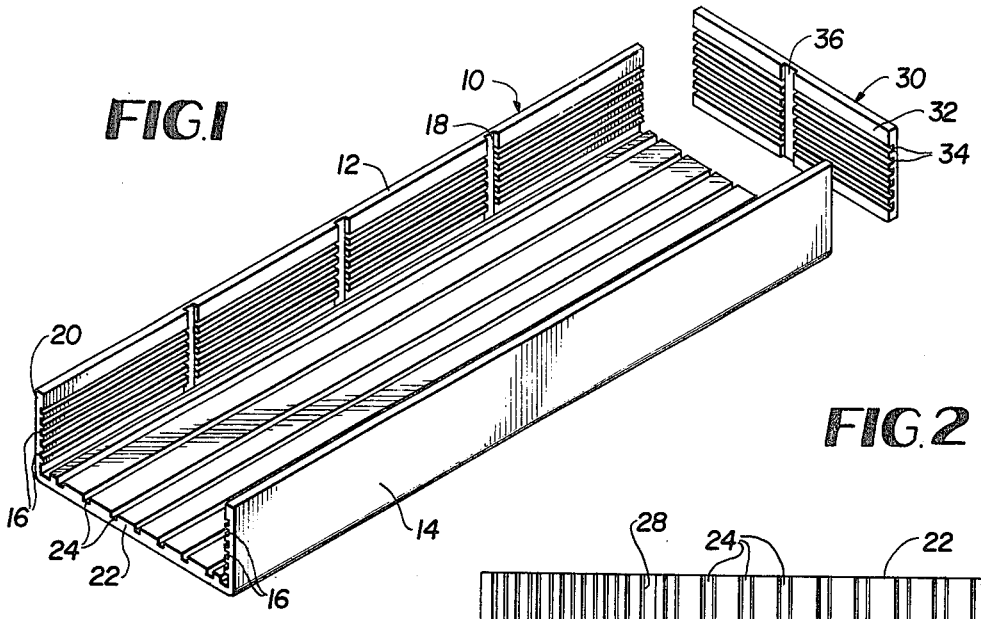
FIG. 1 is a side elevational view depicting a railroad timber tie cover in an operative configuration along with an optional end piece for engaging a railroad timber tie.
Figure 2:
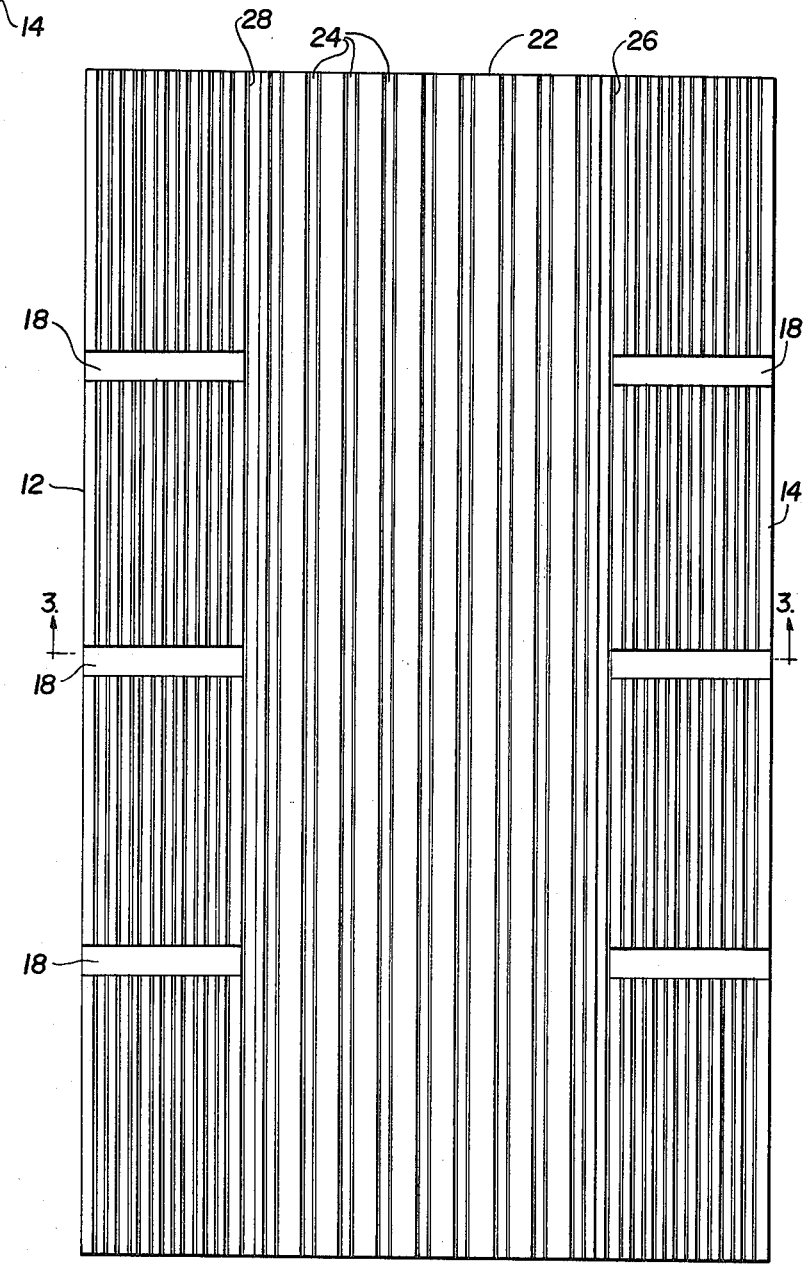
FIG. 2 is a plan view of a railroad timber tie cover in a flat configuration.
Figure 3:
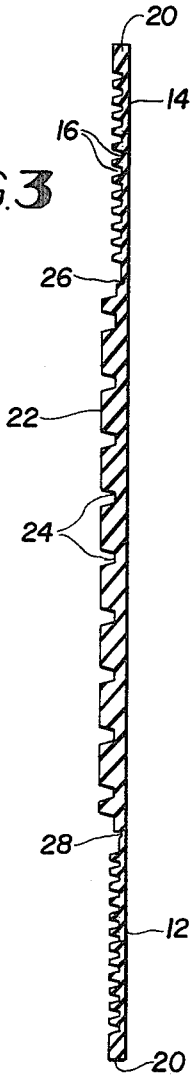
FIG. 3 is a sectional elevational view of the railroad timber tie cover taken along the line 3—3 of FIG. 2.

Referring now to FIGS. 1, 2 and 3 a railroad timber tie cover 10 formed from rubber or other elastomer material is illustrated having two sides 12 and 14 which when attached to the sides of the railroad timber tie forms a protective cover for providing resiliency and prolonging the life of the wooden timber tie. Sides 12 and 14 include a plurality of horizontal channels 16 for providing resiliency to the side walls and the circulation of air around the sides of the timber ties after the novel timber tie cover has been installed. Channels 16 are bi-sected at various points along sides 12 and 14 by a plurality of grooves 18 to assist in the channeling of water and moisture from the sides of the timber tie to the bottom supporting surfaces of the timber tie. Grooves 18 are formed in sides 12 and 14 at a point below the lips 20 on sides 12 to 14 to minimize the amount of water and moisture that is admitted between the sides of the timber tie and the sides 12 and 14 of the railroad timber tie cover. Typically grooves 18 interconnect all of the channels 16 to provide drainage of moisture from channels 16 to the bottom portion of the timber tie.

Similarly, the center or bottom portion 22 of the railroad timber tie cover includes a plurality of channels or grooves 24 disposed along the inside surface of the railroad tie cover. Channels 24 serve the dual purpose of not only increasing the degree of resiliency of the railroad timber tie cover but also providing drainage channels for the removal of moisture and providing for the expansion and contraction of the channels during load passage to provide aeration to the bottom of the wooden railroad tie.

Center portion 22 is formed in a manner to provide an increased cross-sectional thickness which in combination with channels 24 imparts the necessary resiliency and air circulation to the railroad timber tie cover. The resiliency of the center portion can be provided for by increasing and decreasing the hardness of the elastomer pad in combination with the number and depth of grooves. The present invention may also be utilized for concrete railroad ties where resiliency rather than aeration is the primary consideration. In all such applications of the invention it is preferable to utilize an elastomer material with a shore A hardness in the range of 60 and then modify the resiliency or elasticity of the rail tie cover by increasing the percentage of grooves per square inch, increasing the depth of the grooves, or both. Typically, where the railroad timber tie cover is utilized in the ballasted track system the center portion 22 is generally a thickness of about $\frac{3}{8}$ to $\frac{5}{8}$ of an inch measured from the outside wall to the top supporting surface of center portion 22. The depth of grooves 24 is about $\frac{1}{4}$ to $\frac{3}{8}$ of an inch and the grooves are in the preferred embodiment spaced along the center portion at intervals of about $\frac{3}{4}$ of an inch apart.

Railroad tie cover 10 is conveniently molded or extruded from an elastomer material having the grooves in the center portion and side walls designed for a ballasted or ballastless railroad track system. In applications involving railroad track without ballast the center portion 22 may be formed of slightly greater cross-sectional thickness and more particularly in the range of about $\frac{1}{2}$ to $\frac{3}{4}$ of an inch with the groove depth being typically about $\frac{3}{8}$ to $\frac{5}{8}$ of an inch and distributed along the center portion at an interval of about $\frac{1}{2}$ to 1 inch. In the preferred embodiment two strips of reduced thickness 26 and 28 are disposed along the length of the railroad timber tie cover to assist in the folding of sides 12 and 14 against the sides of the railroad timber tie. Various fastening systems such as nails, adhesives, or other known methods of attaching the sides 12 and 14 to the railroad tie may be employed.

The stability of the railroad tie on the grooved or channelled elastomer support is related to the depth and width ratio of the elastomer ridges or channels. The stability is further related to the hardness of the railroad bed. In the case of a hard railroad base such as concrete the highest feasible shape factor is preferred, or in other words, a groove or channel pattern must be utilized which will not jeopardize the stability of the elastomer support while providing the highest degree of vertical deflection. In installations on softer beds such as ballast, the percentage of channels or grooves per square inch can be smaller or the depth of the channels reduced. As a result, the particular relationship of the groove width and depth and groove pattern along with the shore A hardness of the elastomer pad can be varied to suit the particular requirements for the type of railroad bed and the type of railroad tie employed.

An optional end cover or flap 30 (FIG. 1) may be provided for attachment to the end of the railroad timber tie to cover and aerate the end of the railroad timber tie. The utilization of cover 30 assists in prolonging the operational life of the railroad timber tie by providing for the circulation of air and the channeling of moisture away from the timber tie in a manner similar to that provided by sides 12 and 14 and assists in resiliently absorbing lateral track forces. More particularly, the advantages of the end flap are achieved by the utilization of a lip 32 for preventing moisture from entering in the railroad timber tie and also a series of channels 34 similar to channels 16 on sides 12 and 14. Similarly, a groove 36 is provided for connecting the channels 34 together and to provide a drain to the bottom of the timber tie and preferably into one of the grooves 24 at the bottom of the timber tie cover.

Figure 4:
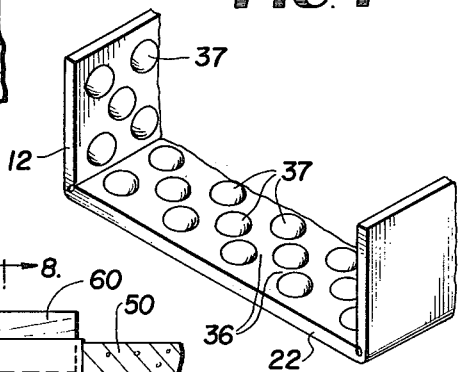
FIG. 4 is a side elevational view of an alternative embodiment for providing grooves to achieve the advantages of the invention.
Figure 5:
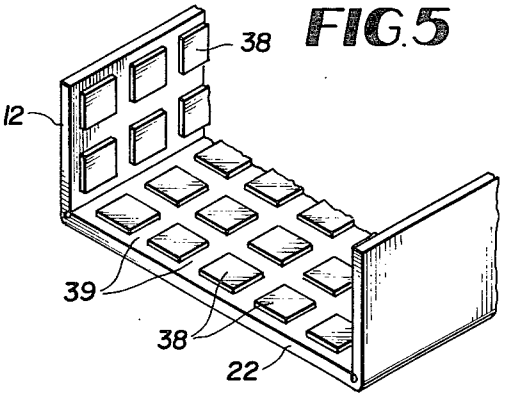
FIG. 5 is a side elevational view of a further alternative embodiment for providing grooves in accordance with the invention.

Referring now to FIGS. 4 and 5 an alternative embodiment is illustrated for providing grooves or channels for railroad tie covers. The advantage of the present invention is achieved by employing a plurality of longitudinal grooves for providing resiliency and drainage for railroad timber ties or merely resiliency for concrete timber ties. In either application of the invention the substantially longitudinal grooves or channels may be formed in a variety of shapes and configurations. In FIG. 4, substantially longitudinal grooves 36 are formed by the utilization of spheroid projections 37 from the center portion 22 and the side wall 12. In FIG. 5, a further disposition of grooves is provided to achieve the advantages of the invention. In FIG. 5, the substantially longitudinal grooves 39 are provided by forming rectangular or bifurcated pyramoidal projections 38 from the center portion 22 and side 12. It will be recognized that in applications involving concrete ties the resiliency may be provided by the utilization of grooves or channels without the necessity of their being longitudinal or along the entire length of the rail tie cover and that the definition of grooves or channels as contemplated by the present invention contemplates such modifications as illustrated in FIGS. 4 and 5. It will be further recognized that the advantages of the invention can be accomplished by utilizing a variety of configurations of the channels and grooves that are designed to increase the overall resiliency of the railroad track thereby reducing track maintenance and noise while increasing the life of the railroad ties.

Figure 6:
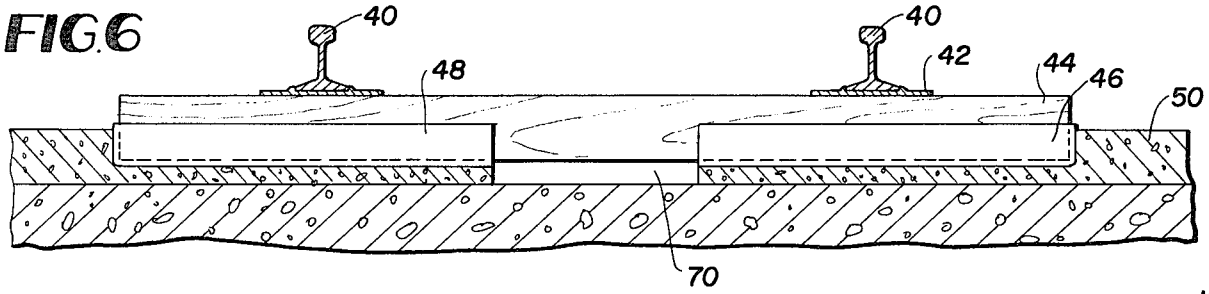
FIG. 6 is a side elevational view of railroad track on concrete slabs utilizing a pair of the novel railroad timber tie covers.

Referring now to FIG. 6, application of the novel railroad timber tie cover to a railroad timber tie is illustrated. In FIG. 6, a pair of rails 40 are set on a conventional steel tie plate 42 which is supported by the rail tie 44. In FIG. 6, the rail tie 44 is covered by two novel rail tie covers 46 and 48 which are utilized to provide resiliency to protect, aerate and drain water and drain moisture away from the railroad timber tie 44. In FIG. 6, the particular application illustrates a ballastless railroad system wherein a concrete or aggregate 50 is utilized to maintain tie 44 in its position. As a result, protective rail covers 46 and 48 preferably employ a center portion having an increased cross-sectional thickness as heretofore described. In such systems, the utilization of the plurality of grooves 24 in the bottom of the center portion 22 of the railroad timber tie cover effectively operate to cushion and dissipate vibrational forces that would otherwise significantly reduce the operational life of a wooden timber tie. Similarly, the utilization of the novel railroad timber tie cover in ballasted systems also increases the operational life of the timber tie and reduces noise and vibration in the overall rail system.

Figure 7:
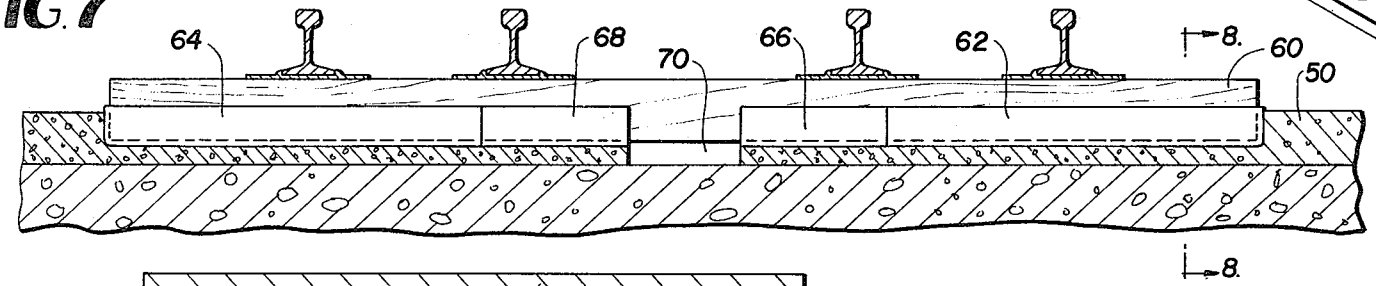
FIG. 7 is a side elevational view of railroad tracks on concrete slabs utilizing railroad timber tie covers of the present invention illustrating a further application of the invention for special track work.
Figure 8:
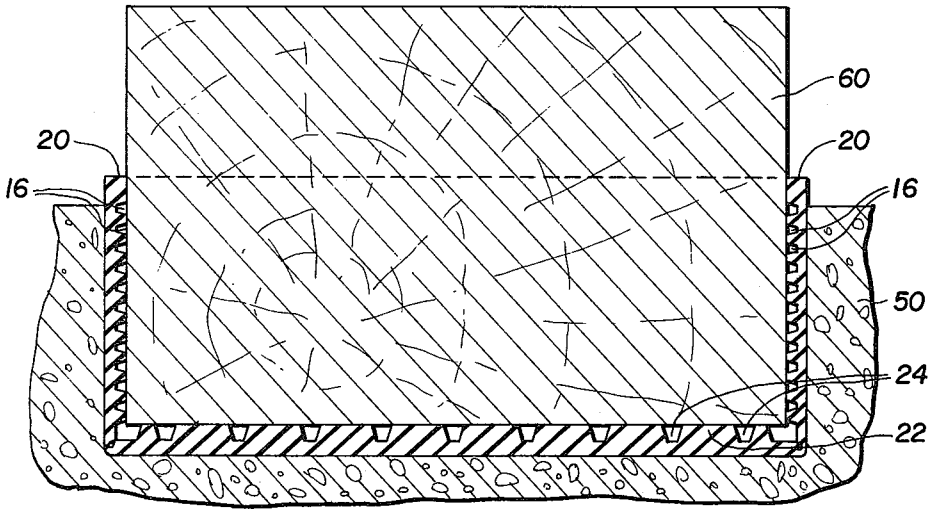
FIG. 8 is a cross-sectional view of FIG. 5 taken along the line 8—8 of FIG. 7.

Referring now to FIGS. 7 and 8 further advantages of the invention are apparent in the application of the railroad timber tie cover to special track work. More particularly, in FIG. 7 the utilization of the railroad timber tie covers for ties of extra long length is illustrated in a ballastless railroad tie system. Basically, the difference between FIG. 6 and FIG. 7 is the utilization of the longer ties in special track work. In FIG. 7 tie 60 is covered by the railroad tie covers 62 and 64 along with portions 66 and 68 of another rail tie cover which had been cut in half to accomodate the longer tie 60. Alternatively, it will be recognized that in instances where a shorter rail tie cover is utilized one of the rail tie covers may be cut at the track site to accomodate the size of the railroad tie. In both applications as illustrated in FIGS. 6 and 7 the water or moisture is drained from the sides and center portion of the railroad ties down to the middle drainage channel 70 provided in the railroad bed of concrete 50.

In FIG. 8, the disposition of the novel railroad timber tie cover around timber tie 60 is illustrated depicting the manner in which the lips 20 are designed to cover the railroad tie along with the disposition of the grooves 16 and 24 in the novel rail tie cover.

The novel rail tie cover is designed to dissipate load and vibrational forces and to thereby reduce strain and increase the operational life of both concrete and wooden railroad ties. In addition, the novel rail tie cover is susceptible to manufacture and shipment in a flat configuration thereby saving space while increasing the service life of railroad ties. The novel rail tie cover further reduces noises and can be installed at the work site to meet the particular requirements of the railroad tie that is covered at the work site.

As will be recognized by those skilled in the art the present invention has a wide range of applicability to railroad systems with or without ballast where wooden railroad ties or ties of similar molded material are employed. In addition, the manner in which the invention is utilized to increase track resiliency is such that the novel rail tie cover can be utilized to increase the resiliency of concrete ties. Furthermore, the railroad tie cover due to its versatility can be manufactured and shipped in a flat configuration and thereafter be cut at the work site to accomodate the specific length of the rail tie at the track site. The invention may be implemented in a variety of ways utilizing a variety of configurations for the grooves and channels to provide for aeration, shock and frequency dissipation aspects of the present invention and by utilizing a variety of cross-sectional widths for the novel rail timber tie cover. It will be further appreciated that the present invention is susceptible to various modifications which can be made within the spirit and scope of the invention as defined in the following claims.

What is claimed is:

1. A railroad tie cover for imparting resiliency to a track system while prolonging the life of a tie comprising a substantially rectangular sheet formed of an elastomer material having a first surface adapted to contact a railroad tie and a second surface opposite said first surface said surfaces providing a center portion of a cross sectional thickness of from about $\frac{3}{8}$ to $\frac{3}{4}$ of an inch and a first side and a second side having a cross sectional thickness less than said center portion said sides connected to said center portion and adapted to deform so as to orient said first surface of said first and second sides to an angle of about 90 degrees to said first surface of said center portion said first surface having disposed therein a plurality of longitudinal grooves substantially parallel to said sides and spaced at about $\frac{1}{4}$ to 1 inch from each other and to a depth of about $\frac{1}{4}$ to $\frac{3}{8}$ of an inch.

2. The railroad tie cover for imparting resiliency to a rail track system while prolonging the life of a tie of claim 1 wherein said first and second sides contact opposite sides of said railroad tie when oriented at said angle, said first and second sides include a plurality of substantially longitudinal grooves spaced at about $\frac{1}{4}$ to $\frac{1}{2}$ inch apart from each other and to a depth of about $\frac{1}{8}$ to $\frac{1}{4}$ inch and substantially parallel to said grooves in said center portion.

3. The railroad tie cover for imparting resiliency to a track system while prolonging the life of a tie of claim 2 wherein said first and second sides further include a plurality of grooves disposed substantially perpendicular to said plurality of longitudinal grooves in said first and second sides.

4. The railroad tie cover for imparting resiliency to a rail track system while prolonging the life of a tie of claim 1 wherein said first and second sides have a cross-sectional thickness of about $\frac{1}{4}$ to $\frac{3}{8}$ of an inch.

5. The railroad tie cover for imparting resiliency to a rail track system while prolonging the life of a tie of claim 1 further comprising a substantially rectangular end flap having a plurality of longitudinal grooves for covering the end of the railroad tie.

6. The railroad tie cover for imparting resiliency to a rail track system while prolonging the life of a tie of claim 5 wherein said rectangular cover includes at least one groove disposed substantially perpendicular to said plurality of longitudinal grooves in said rectangular cover.

7. The railroad tie cover for imparting resiliency to a rail track system while prolonging the life of a tie of claim 1 wherein said center portion has a cross-sectional thickness of from about $\frac{3}{8}$ to $\frac{5}{8}$ of an inch and said grooves in said center portion are spaced at about $\frac{1}{3}$ to 1 inch from each other and are at a depth of about $\frac{1}{4}$ to $\frac{3}{8}$ of an inch.

8. The railroad tie cover for imparting resiliency to a rail track system while prolonging the life of a tie of claim 7 wherein said first and second sides have a cross-sectional thickness in the range of from about $\frac{1}{4}$ to $\frac{3}{8}$ of an inch.

9. The railroad tie cover for imparting resiliency to a rail track system while prolonging the life of a tie of claim 1 wherein said center portion has a cross-sectional thickness of from about $\frac{1}{2}$ to $\frac{1}{4}$ of an inch and said plurality of longitudinal grooves in said center portion are spaced at about $\frac{1}{4}$ to $\frac{1}{2}$ inch from each other.

10. The railroad tie cover for imparting resiliency to a rail track system while prolonging the life of a tie of claim 9 wherein said first and second sides have a cross-sectional thickness in the range of from about $\frac{1}{4}$ to $\frac{3}{8}$ of an inch.

11. The railroad tie cover for imparting resiliency to a rail track system of claim 1 wherein said elastomer material has a shore A hardness in the range of 60.

* * * * *

UNITED STATES PATENT AND TRADEMARK OFFICE

CERTIFICATE OF CORRECTION

PATENT NO. : 4,356,968

DATED : November 2, 1982

INVENTOR(S) : JOHN L. HARMSEN

It is certified that error appears in the above—identified patent and that said Letters Patent is hereby corrected as shown below:

by correcting Claim 9 at column 10, line 29, improperly reading "1/2 to 1/4 of an inch", to properly read -- 1/2 to 3/4 of an inch --.

Signed and Sealed this

*Ninth* Day of *October 1984*

[SEAL]

*Attest:*

GERALD J. MOSSINGHOFF

*Attesting Officer*

*Commissioner of Patents and Trademarks*